US009795231B2

(12) United States Patent
Smith et al.

(10) Patent No.: US 9,795,231 B2
(45) Date of Patent: Oct. 24, 2017

(54) MATTRESS COVER

(71) Applicants: J. Tedd Smith, Asheville, NC (US); Henry Stephen Hutcherson, Flat Rock, NC (US)

(72) Inventors: J. Tedd Smith, Asheville, NC (US); Henry Stephen Hutcherson, Flat Rock, NC (US)

( * ) Notice: Subject to any disclaimer, the term of this patent is extended or adjusted under 35 U.S.C. 154(b) by 0 days.

(21) Appl. No.: 14/258,677

(22) Filed: Apr. 22, 2014

(65) Prior Publication Data

US 2014/0317845 A1 Oct. 30, 2014

Related U.S. Application Data

(60) Provisional application No. 61/816,033, filed on Apr. 25, 2013.

(51) Int. Cl.
*A47G 9/02* (2006.01)

(52) U.S. Cl.
CPC ..... *A47G 9/0246* (2013.01); *Y10T 29/49826* (2015.01)

(58) Field of Classification Search
CPC ..... A47G 9/02
USPC ..... 5/482, 485, 497
See application file for complete search history.

(56) References Cited

U.S. PATENT DOCUMENTS

| | | | | |
|---|---|---|---|---|
| 2,162,755 | A * | 6/1939 | Shauer | 5/497 |
| 2,637,049 | A * | 5/1953 | Kromer et al. | 5/497 |
| 5,809,593 | A * | 9/1998 | Edwards | A47G 9/0246 40/299.01 |
| 6,983,500 | B2 * | 1/2006 | Wootten | 5/497 |
| 7,240,383 | B2 | 7/2007 | Stewart | |
| D677,964 | S * | 3/2013 | Agarwall | D6/602 |
| 2005/0011007 | A1 * | 1/2005 | Lintner | 5/497 |

* cited by examiner

*Primary Examiner* — Fredrick Conley
(74) *Attorney, Agent, or Firm* — Ward and Smith, P.A.; Ryan K. Simmons

(57) ABSTRACT

A mattress cover including a substantially rectangular piece of material including a top center portion for fitting upon a top surface of a mattress, and a peripheral skirt portion including two end panels and two side panels, wherein the respective end panels and side panels may be attached together at each corner for fitting over corresponding sides and ends of the mattress, corner panels attached to a bottom portion of each corner formed from the respective attached end panels and side panels, wherein the corner panels may be substantially parallel to the top center portion, and one or more elastic bands attached around a bottom periphery of an inside edge of the skirt portion and corner panels.

17 Claims, 8 Drawing Sheets

MATTRESS COVER

RELATED APPLICATIONS

This patent application is related to and claims priority to U.S. Provisional Patent Application No. 61/816,033, filed on Apr. 25, 2013, titled "Mattress Cover" the entire disclosure of which is incorporated herein by reference.

FIELD OF THE INVENTION

The invention relates generally to a mattress covering such as a fitted mattress cover, including, but not limited to, a fitted bed sheet, fitted mattress pad, and/or fitted mattress protector. More particularly, the invention relates to a mattress cover for placement on mattresses of a continuum of mattress depth sizes, from thin to thick, and varying lengths and/or widths, in a manner that substantially prevents the mattress cover from being pulled loose from the corners or undesirably bunching while allowing the mattress covering to neatly and snugly cover the sides, ends, and top of the mattress.

BACKGROUND

Fitted sheets, mattress pads, mattress protectors, and the like, have been used as an easy way of covering mattresses. Most of the current products work well, but only when they are configured properly to fit the specific mattress on which they are placed. In particular, a user purchases a fitted sheet, or the like, sized specifically for the mattress they intend to cover—whether it be a crib, toddler, twin, full, queen, king, etc. Historically, this was sufficient because the length, thickness, and widths of these various mattress sizes were relatively consistent, e.g., a thickness of about six (6) inches to about eight (8) inches. However, during the past twenty (20) or so years the mattress market has changed to include not only the six (6) to eight (8) inch (thickness) mattresses which were previously commonplace, but to now also include mattresses that are up to about 21 inches thick. Additionally, strict industry-wide mattress size standards (length and width) from years past no longer exist. For example, some twin mattresses can be found ranging from about 37 inches to about 39 inches in width and some king size mattresses range from about 72 inches to about 78 inches in width. Also, twin mattresses, and others, now sometimes come in "extra-long" varieties that can range in length from about 75 inches to about 80 inches.

When trying to find mattress covers for mattresses of such varying thicknesses, lengths, and/or widths within certain mattress classifications (e.g., crib, toddler, twin, full, queen, king, etc.), users find that existing products are not always desirable. For example, as illustrated in FIG. 1, some fitted mattress covers are configured for mattresses of a thickness greater than the mattress on which the cover is installed, resulting in undesirable bunching of the mattress cover fabric and a generally un-snug fit. On the other hand, as illustrated in FIG. 2, certain other fitted mattress covers are configured for mattresses of a thickness less than the mattress on which the cover is installed, resulting in an inability to fully secure the mattress cover to the mattress and the bottom edge of the fitted sheet barely reaches the bottom edge of the mattress and thus, constantly pulling free, or in some cases the inability to install the mattress cover altogether. Users are therefore required to purchase fitted mattress covers that are not only configured to fit the general mattress classifications (i.e. twin, full, queen, king, etc.), but also fit different mattress thicknesses and/or variations in length and/or width. With the myriad of size combinations now available, mattress cover manufacturers and retailers have found it almost impossible, and certainly impractical, to maintain an inventory of such mattress covers to fit each and every variation of mattress size available.

There have been many attempts to rectify this situation by producing fitted mattress covers that can accommodate the variation in sizes among different mattress classifications. For example, certain producers have experimented with adding straps, utilizing stretch fabrics, making mattress covers with deeper pockets, and the like. Some of these inventions worked in a limited way, but most of these products perform poorly and are simply not practical for everyday use. In addition, most of these designs are difficult to use (i.e. install on the mattress), difficult to care for (e.g., straps getting tangled in a washing machine), and expensive to manufacture (e.g., stretch fabrics). There are also difficulties associated with color matching when different fabric constructions are required on the same product.

Accordingly, there is a need for fitted mattress cover products for each classification of mattress (e.g., crib, toddler, twin, full, queen, king, etc.) that can snugly fit a wide variety of mattress thicknesses and/or varying lengths and widths within each classification, and that is also easy to use, easy to care for, and economically feasible to manufacture. It would, therefore, be desirable to provide a mattress covering that is designed to snugly and neatly fit both thin and thick mattresses and/or mattresses of varying widths and lengths, without inadvertently coming off the mattress while being easy to use, care for, and manufacture.

SUMMARY

In one embodiment the invention provides a mattress cover. The mattress cover may include a substantially rectangular piece of material including a top center portion for fitting upon a top surface of a mattress, and a peripheral skirt portion including two end panels and two side panels, wherein the respective end panels and side panels may be attached together at each corner for fitting over corresponding sides and ends of the mattress, corner panels attached to a bottom portion of each corner formed from the respective attached end panels and side panels, wherein the corner panels may be substantially parallel to the top center portion and include at least one interior edge, one or more elastic bands attached around a bottom periphery of an inside edge of the skirt portion and corner panels, and wherein the substantially rectangular piece of material with the respective end panels and side panels attached together at each corner is configured for covering at least the top surface, sides, and ends of the mattress, and the corner panels attached to the bottom portion of each corner formed from the respective attached end panels and side panels, and the one or more elastic bands attached around a bottom periphery of the inside edge of the skirt portion and fabric panels are configured to fit substantially under the mattress and secure the mattress cover to the mattress. The top center portion, peripheral skirt portion, and the corner panels may be manufactured from a single piece of material. The mattress cover may be configured to fit a mattress of thickness varying in the range of about six (6) inches to about 21 inches, varying widths in the range of about 37 inches to about 39 inches, and varying widths in the range of about 72 inches to about 78 inches. The corner panels may be substantially triangular in shape and/or include isosceles right triangles. The mattress cover may include cotton, cotton/polyester blend, wool, silk, synthetic, nonwoven, quilted, felted, multi-layered fabric, and waterproofed material. The mattress may be a crib, toddler, twin, twin extra-long, full, full extra-long, queen, king, and/or California king size mattress. The mattress may also be any other size mattress, including but not limited to, a size that substantially complies with U.S. and/or any other foreign standards.

In certain other embodiments, the invention provides a method of manufacturing a mattress cover. The method may include providing a first piece of material of sufficient size to cover a top area, sides, and ends of a mattress, wherein the first piece of material comprises two end and two side panel portions. Substantially square shaped portions may then be removed from each corner of the first piece of material and the edges of the end panel portions may be attached to respective edges of the side panel portions, thereby forming a seam at each corner of the first piece of material. The method may further provide for shaping the removed substantial square shaped portions to form corner panel portions and attaching the corner panel portions to each corner of the first piece of material, wherein the corners of the first piece of material are formed by the attached edges of the end panel portions to their respective edges of the side panel portions. One or more stretchable bands may then be attached around substantially the entire periphery of an inner edge of a bottom portion of the mattress cover, wherein the bottom portion of the mattress cover is formed by at least a portion of the two end and two side panel portions of the first piece of material and the corner panel portions. The edges of the end panel portions and the side panel portions may be formed at the respective edges where the substantially square shaped portion was removed. The first piece of material may include at least one of cotton, cotton/polyester blend, wool, silk, synthetic, nonwoven, quilted, felted, multi-layered fabric, and waterproofed material. The corner panel portions may be substantially triangular and/or include isosceles right triangles. Furthermore, the mattress cover may be configured to fit a mattress of thickness varying in the range of about six (6) inches to about 21 inches, varies in width in the range of about 37 inches to about 39 inches, and/or varies in width in the range of about 72 inches to about 78 inches. The mattress may include a crib, toddler, twin, twin extra-long, full, full extra-long, queen, king, and California king size mattress, and/or any other size mattress, including, but not limited to, a size that substantially complies with U.S. and/or any other foreign standards.

DETAILED DESCRIPTION

Figure 1:
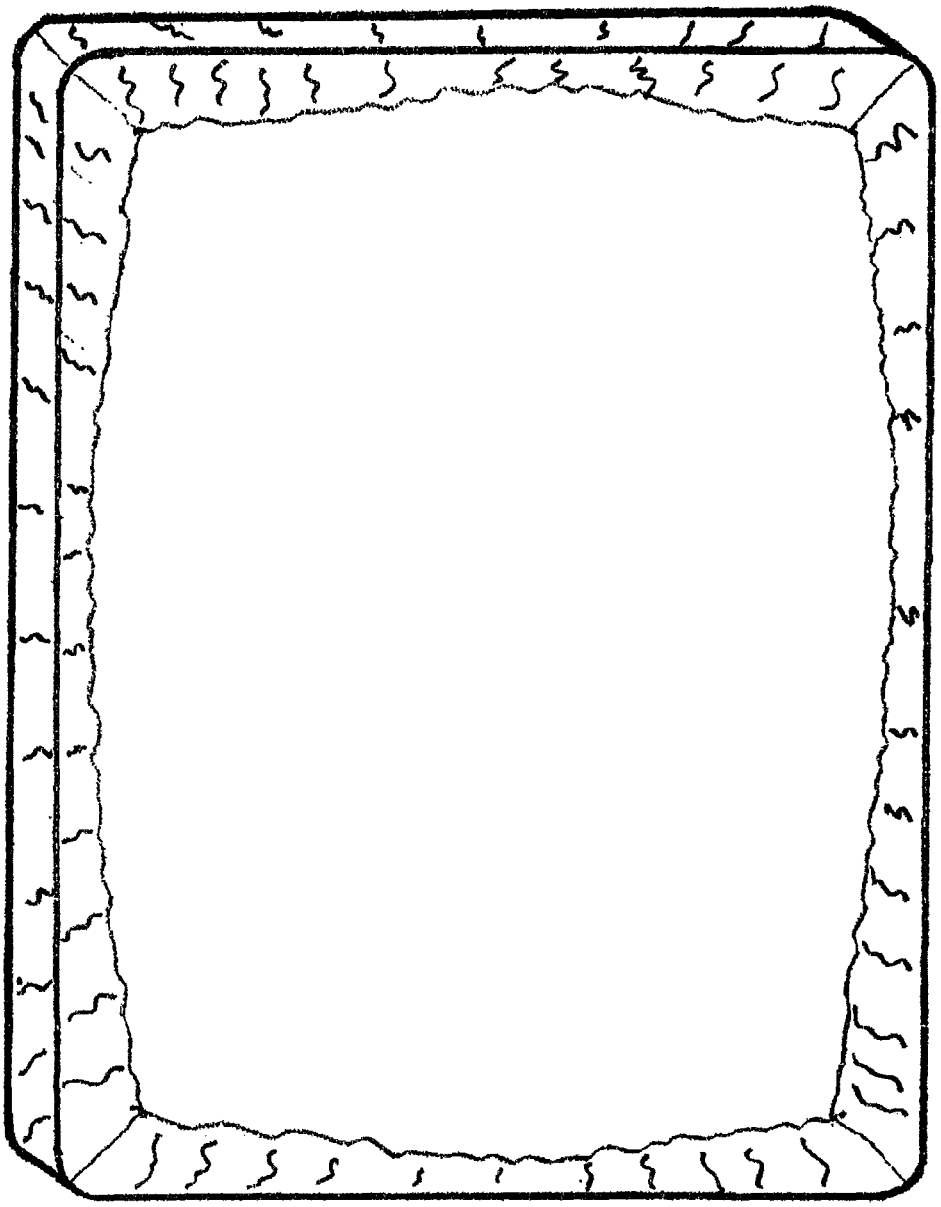
FIG. 1 illustrates a conventional fitted sheet installed on a thin mattress showing the sides and ends of the fitted sheet being wrinkled.
Figure 2:
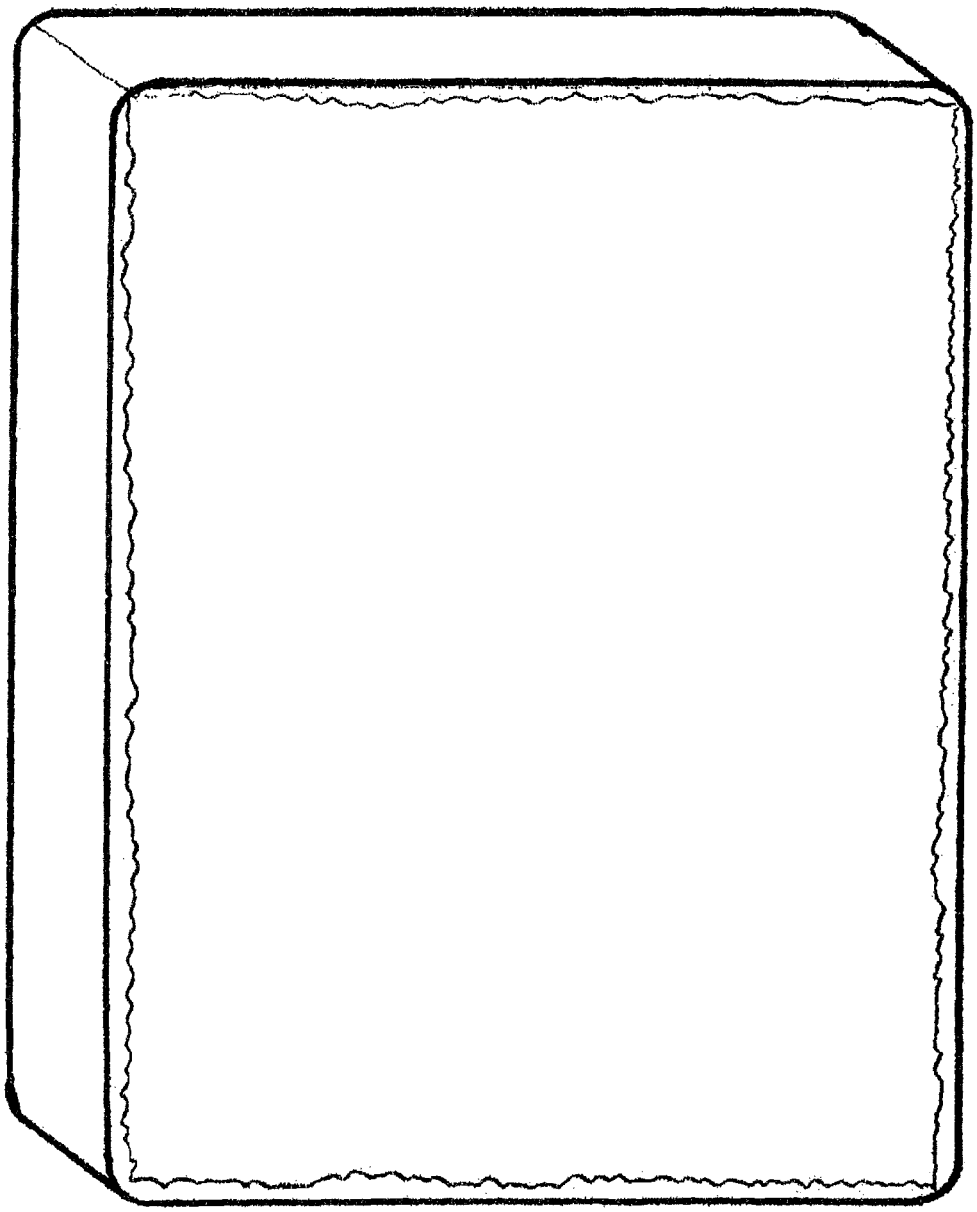
FIG. 2 illustrates a conventional fitted sheet installed on a thick mattress showing the fitted sheet about to slip off the thicker mattress at the bottom corners, ends, and sides of the mattress.

The invention now will be described more fully hereinafter with reference to the accompanying figures, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the invention may be directed to a mattress cover, such as a fitted mattress cover including, but not limited to, a fitted bed sheet, fitted mattress pad, fitted mattress protector, or the like. In certain embodiments, the mattress cover may be configured to accommodate mattresses of varying thicknesses, including, but not limited to, mattresses in the range of about six (6) inches to about 21 inches thick. The mattress cover may be further configured to accommodate certain variances in length and/or width among different mattress classifications (e.g., crib, toddler, twin, twin XL, full, full XL, queen, king, California king, etc.). The mattress cover may also include multiple portions. For example, the mattress cover may include a top portion of material for covering and fitting a top area of the mattress, a peripheral skirt that fits sides and ends of the mattress, four corner panel portions (e.g., one in each corner) configured to fit under the bottom side of each mattress corner for securing the mattress cover to the mattress, and one or more elastic bands preferably attached around the entire periphery of the bottom of the sides, ends, and inside edges of the corner panel portions.

In some embodiments, the invention may be designed to snugly and neatly fit both thin and thick mattresses without undesirably bunching and/or inadvertently coming off the mattress while also being easy to install, care for, and manufacture. In one embodiment, the mattress cover may be manufactured primarily from a single base piece of material. The single piece of material may then be separated (e.g., by cutting) into multiple pieces and integrated with one or more stretchable bands, such as an elastic band. In one embodiment, a first piece of the base material may substantially cover a top portion, ends, and sides of a mattress. The first piece of material may be generally rectangular in shape, or any other shape as desirable to best accommodate the mattress to be covered. The first piece may then have squares cut from each corner during the manufacturing process. The squares may then be preferably cut away from the first piece of material and the cut edges of the respective end and side portions may then be attached together to form an inverted box like shape. In preferred embodiments, the cut edges may then be sewn together. In some embodiments, one or more of the square cut-outs for each corner may be further cut substantially in half diagonally, or in any other configuration, and then attached (e.g., sewn) to the open corner of the bottom portion of the inverted box. Note that while square cut outs are described as the example in this paragraph, any desirable shape may be cut from the material to best accommodate the mattress to be covered.

Figure 3:
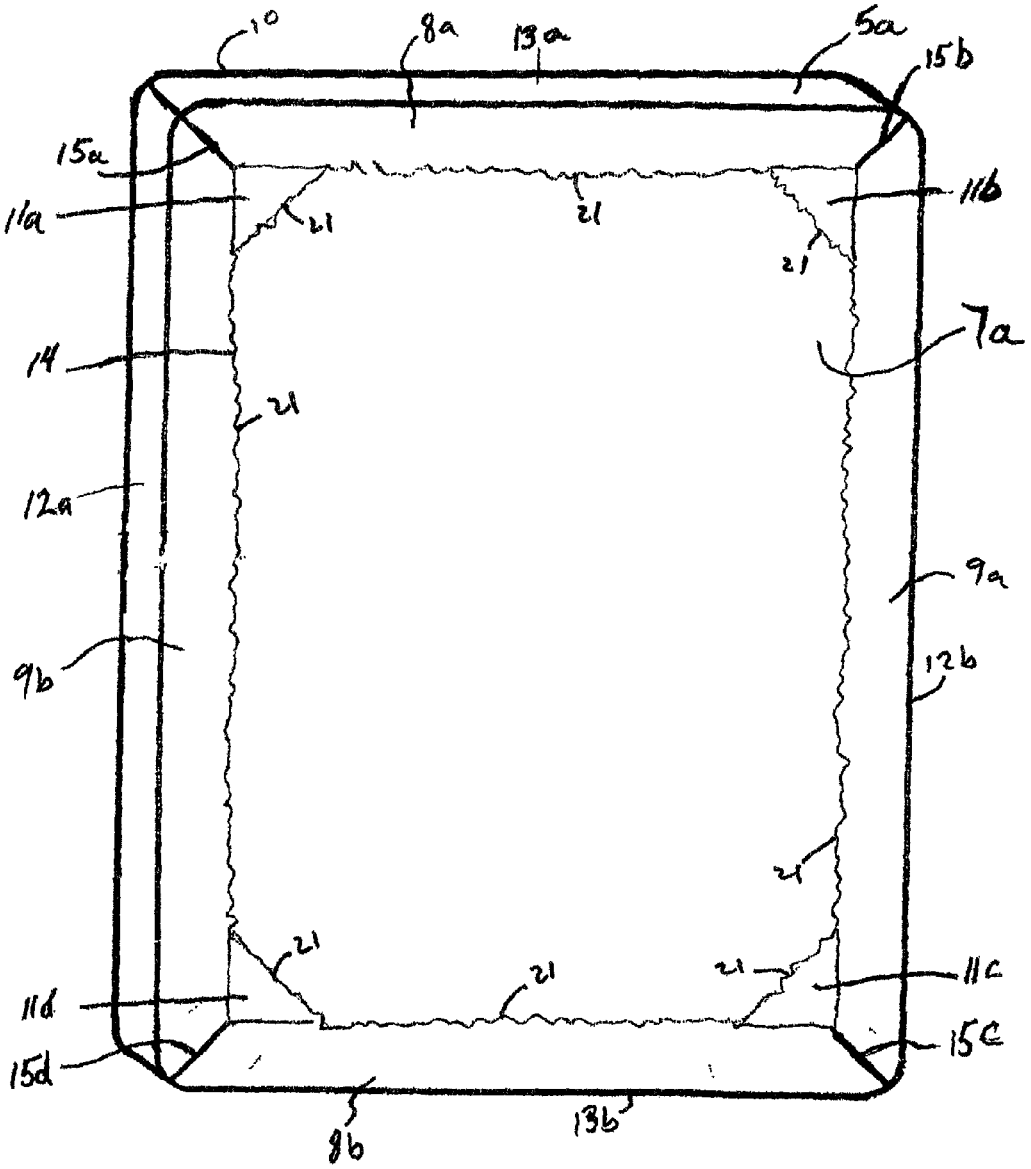
FIG. 3 illustrates an embodiment of the presently disclosed mattress cover installed on a thin mattress showing that the bottom portion of the sheet is pulled more toward the center of the mattress making the sides and ends of the sheet smoother.
Figure 4:
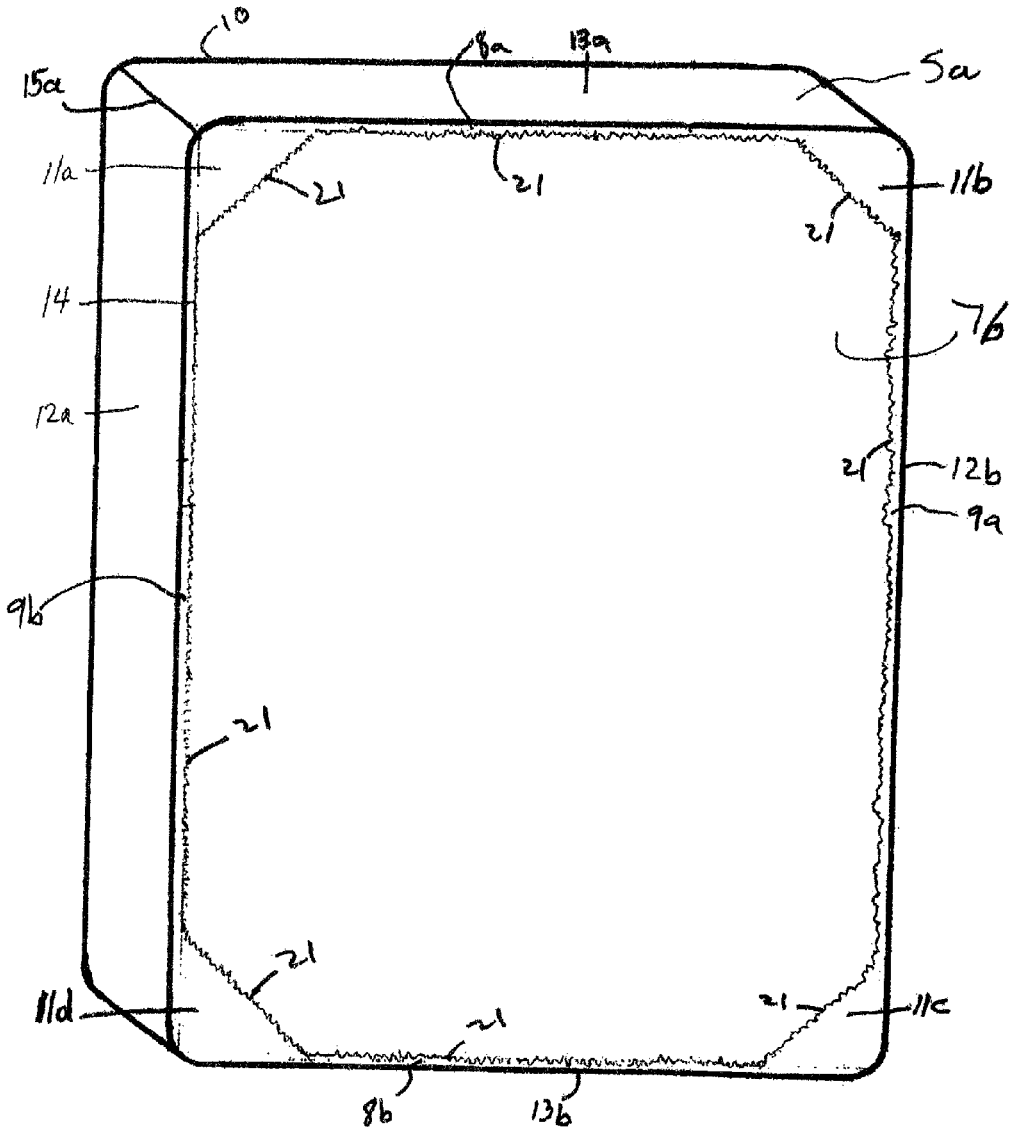
FIG. 4 illustrates an embodiment of the presently disclosed mattress cover installed on a thick mattress showing that the corner panels of the mattress cover are covering the bottom corners of the thicker mattress, thus preventing it from sliding off the mattress.

With reference to FIG. 3 and FIG. 4, a mattress cover 5*a* is preferably designed to snugly and neatly fit a mattress 7*a* or 7*b*, respectively. Mattress 7*a* or 7*b* may represent any typical mattress that can come in a variety of thicknesses, including for example, a thickness in the range of about six (6) inches to about 21 inches thick. The mattress cover is configured such that it can accommodate the variation in thickness (or similar variations in length and width, as discussed herein below), without inadvertently bunching up on the top and sides of thin mattress 7*a* in an undesirable way or slipping off the thick mattress 7*b*. Specifically, FIG. 3 illustrates an embodiment of the mattress cover 5*a* on a relatively thin mattress 7*a* and FIG. 4 illustrates the mattress cover 5*a* on a relatively thick mattress 7*b*. Note that in both FIGS. 3 and 4, the mattress cover 5*a* fits snugly and neatly to mattress 7*a* and 7*b*, respectively. Further, the mattress cover 5*a* is easy to care for, easy to use, and easy and economical to manufacture.

Mattress cover 5*a* may be manufactured from one base piece of material that may include multiple portions, including, for example, a top portion 10; end portions 8*a* and 8*b*, side portions 9*a* and 9*b*, corner panel portions 11*a*, 11*b*, 11*c*, and 11*d*; and one or more stretchable bands 14, for example an elastic band. Top portion 10, along with end portions 8*a* and 8*b* and side portions 9*a* and 9*b*, may be configured to preferably cover the top area of mattress 7*a* or 7*b*, ends 13*a* and 13*b*, and sides 12*a* and 12*b* of mattress 7*a* or 7*b*, respectively. In some embodiments, the top portion 10 is substantially rectangular, but may be any shape desirable.

Figure 5:
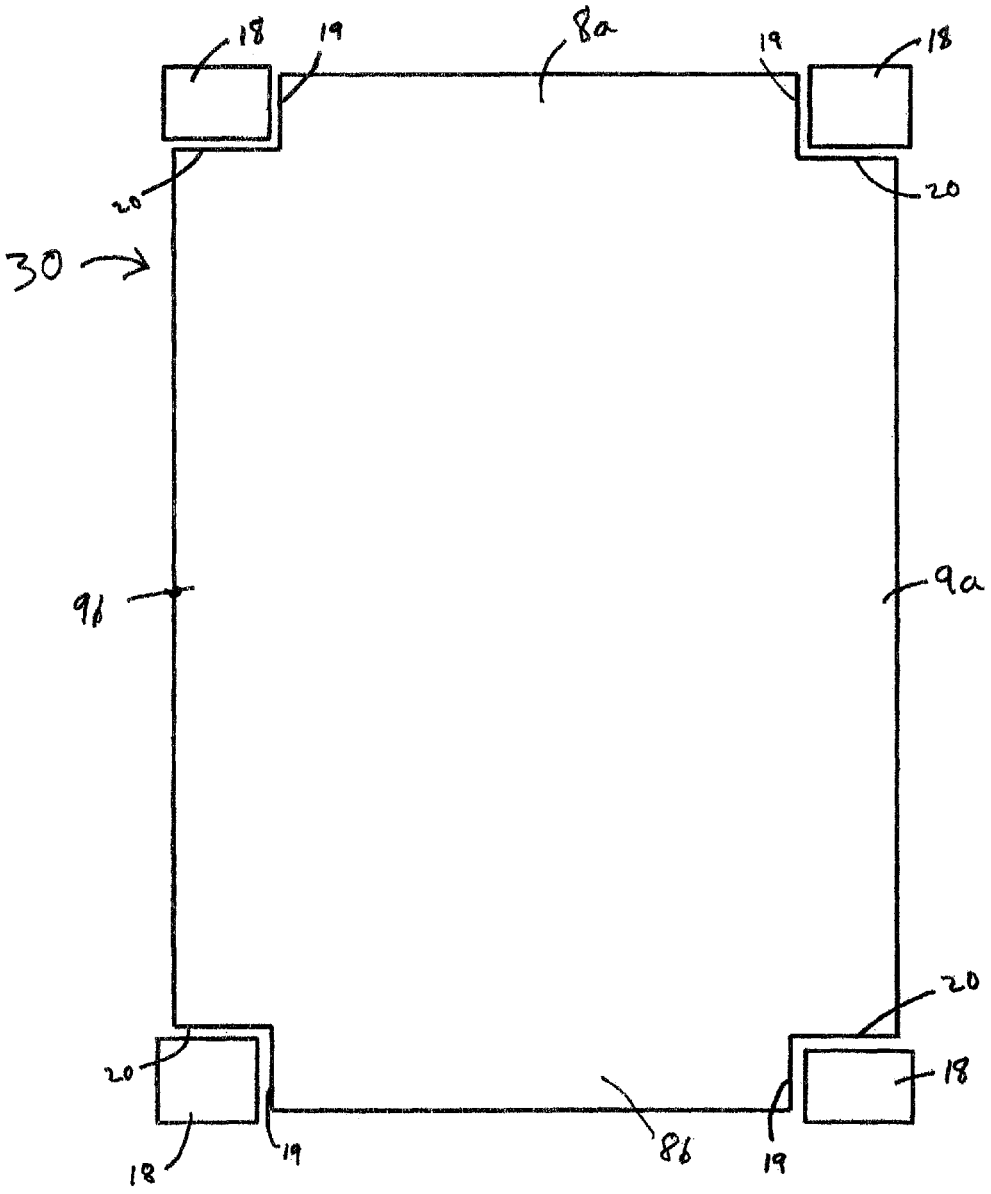
FIG. 5 illustrates a first piece of material used to manufacture certain embodiments of the disclosed mattress cover, including corner pieces that may be removed in the process.

Referring now to FIG. 5, a first piece of material 30 is presented. Material 30 may have corner pieces 18 removed (e.g., by cutting) from each of its corners. In some embodiments, these removed corner pieces 18 are substantially square or rectangular shaped, but may be any shape desirable. Where the removed corner pieces 18 are cut away from material 30, the cut edges 19 of end portions 8*a* and 8*b* may be attached (e.g., sewn) to respective cut edges 20 of side portions 9*a* and 9*b* to form seams 15*a*, 15*b*, 15*c*, and 15*d* shown, for example, in FIG. 3 and FIG. 4, resulting in the inverted box like shape discussed above.

The cut out corner pieces 18 (i.e. removed pieces) may then be cut further as desired and thereafter attached to the open corners of a bottom portion of the inverted box like shape to form corner panel portions 11*a*, 11*b*, 11*c*, and 11*d* (as shown in FIGS. 3-4 and 6-9). In one example, the cut out corner pieces 18 may be cut approximately in half diagonally, forming, for example, triangle shaped corner panel portions 11*a*, 11*b*, 11*c*, and 11*d*. In certain other embodiments, corner panel portions 11*a*, 11*b*, 11*c*, and 11*d* may be isosceles right triangles and may vary in size based on the desired corner pocket size of mattress cover 5*a*. The corner panel portions 11*a*, 11*b*, 11*c*, and 11*d* may, alternatively, be any other size or shape desirable. Additionally, one or more stretchable bands 14 may be attached around a lower edge 21 of the mattress cover 5*a* to hold the edge of the mattress cover 5*a* under the lower edge of the mattress 7*a* or 7*b*, thus securing the mattress cover 5*a* in place.

In some embodiments, the mattress cover may be manufactured from a single base piece of material. As noted above, the fabric may be separated into a rectangle sized piece of material 30 to fit over the mattress top area (not shown), mattress sides 12*a* and 12*b*, and mattress ends 13*a* and 13*b*. A portion (e.g., corner pieces 18) is preferably removed (e.g., cut) from each corner of material 30 to enable the cut edges 19 of end portions 8*a* and 8*b* to be attached (e.g., sewn) to the respective cut edges 20 of side portions 9*a* and 9*b*, forming seams 15*a*, 15*b*, 15*c*, and 15*d*. The cut-out corner pieces 18 may then be cut approximately in half diagonally to form corner panel portions 11*a*, 11*b*, 11*c*, and 11*d* that may then be preferably positioned and attached (e.g., sewn) into the corners formed at the bottom of mattress cover 5*a*. Corner panel portions 11*a*, 11*b*, 11*c*, and 11*d* are preferably fit substantially flat against the bottom of mattress 7*a* or 7*b* and help prevent the mattress cover 5*a* from sliding off the corners on thick mattresses, and to aid in pulling excess material toward the center of a thin mattress making the sides 9*a* and 9*b*, the ends 8*a* and 8*b*, and the top portion 10 appear smoother. The lower edge 21 of the mattress cover 5*a* preferably has one or more stretchable bands 14, e.g., a heavy duty, high regain elastic band, sewn around substantially the lower edge 21 of the open bottom of mattress cover 5*a*. One or more elastic bands 14 can be sewn inside a material hem where it does not show or it can be sewn outside the hem.

Figure 7:
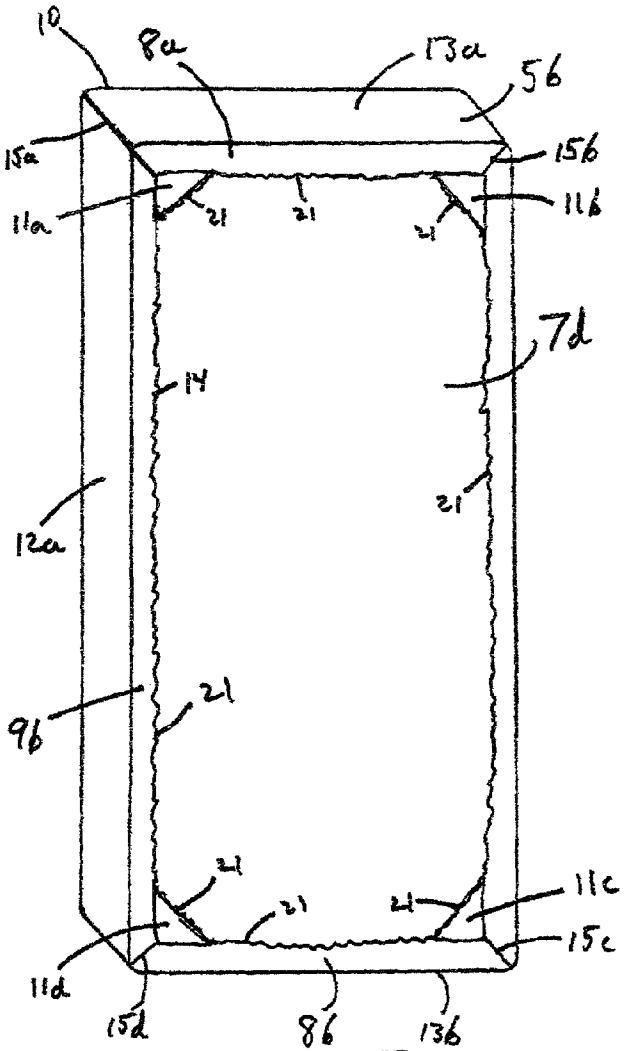
FIG. 7 illustrates an embodiment of the presently disclosed mattress cover installed on an extra-long twin mattress.
Figure 6:
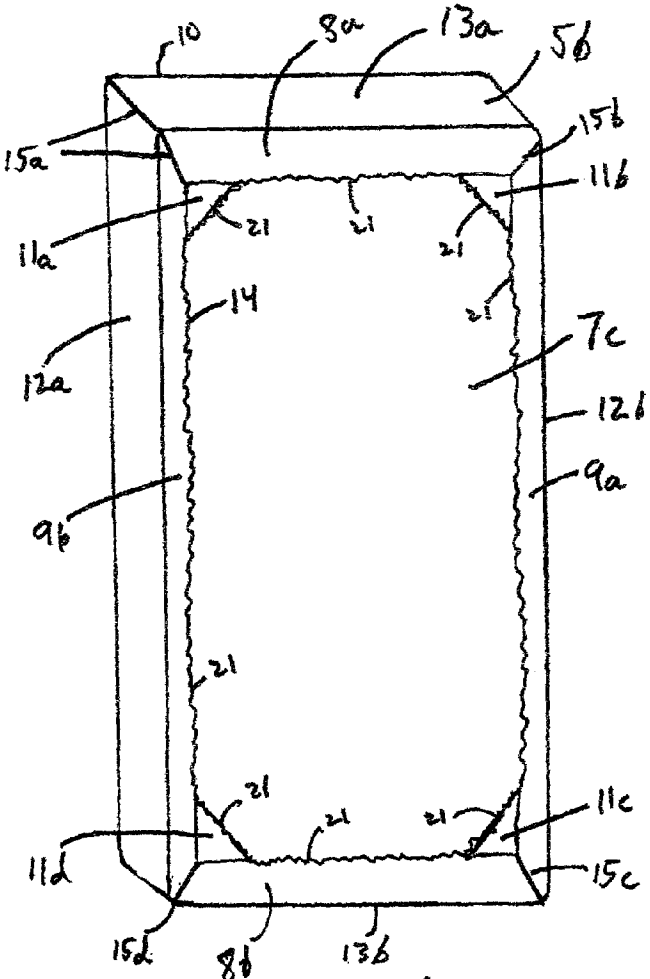
FIG. 6 illustrates an embodiment of the presently disclosed mattress cover installed on a standard twin size mattress.

Various embodiments of the invention are envisioned to accommodate the various classifications of mattresses on which the cover could be desirably installed. Referring to FIG. 6 and FIG. 7, for example, a single mattress cover 5*b* may be configured to fit mattresses of varying thickness that are generally classified as twin sized or twin extra-long. As depicted, the mattress cover 5*b* is shown properly fitting a standard twin size mattress 7*c* in FIG. 6 and a twin extra-long size mattress 7*d* in FIG. 7. Mattress cover 5*b* is configured to provide a substantially smooth covering and to be substantially free of bunched material, as well as staying substantially secured to the mattress when installed on either of the standard twin size mattress 7*c* or the twin extra-long size mattress 7*d*. Mattress cover 5*b* can also accommodate twin sized mattress 7*c* and twin extra-long sized mattress 7*d* of various thicknesses, as discussed above, such as, for example, thicknesses varying from about six (6) inches to about 21 inches. Further still, mattress cover 5*b* may accommodate twin sized mattress 7*c* and twin extra-long sized mattress 7*d* of varying widths, such as, for example, widths varying from about 37 inches to about 39 inches.

Figure 8:
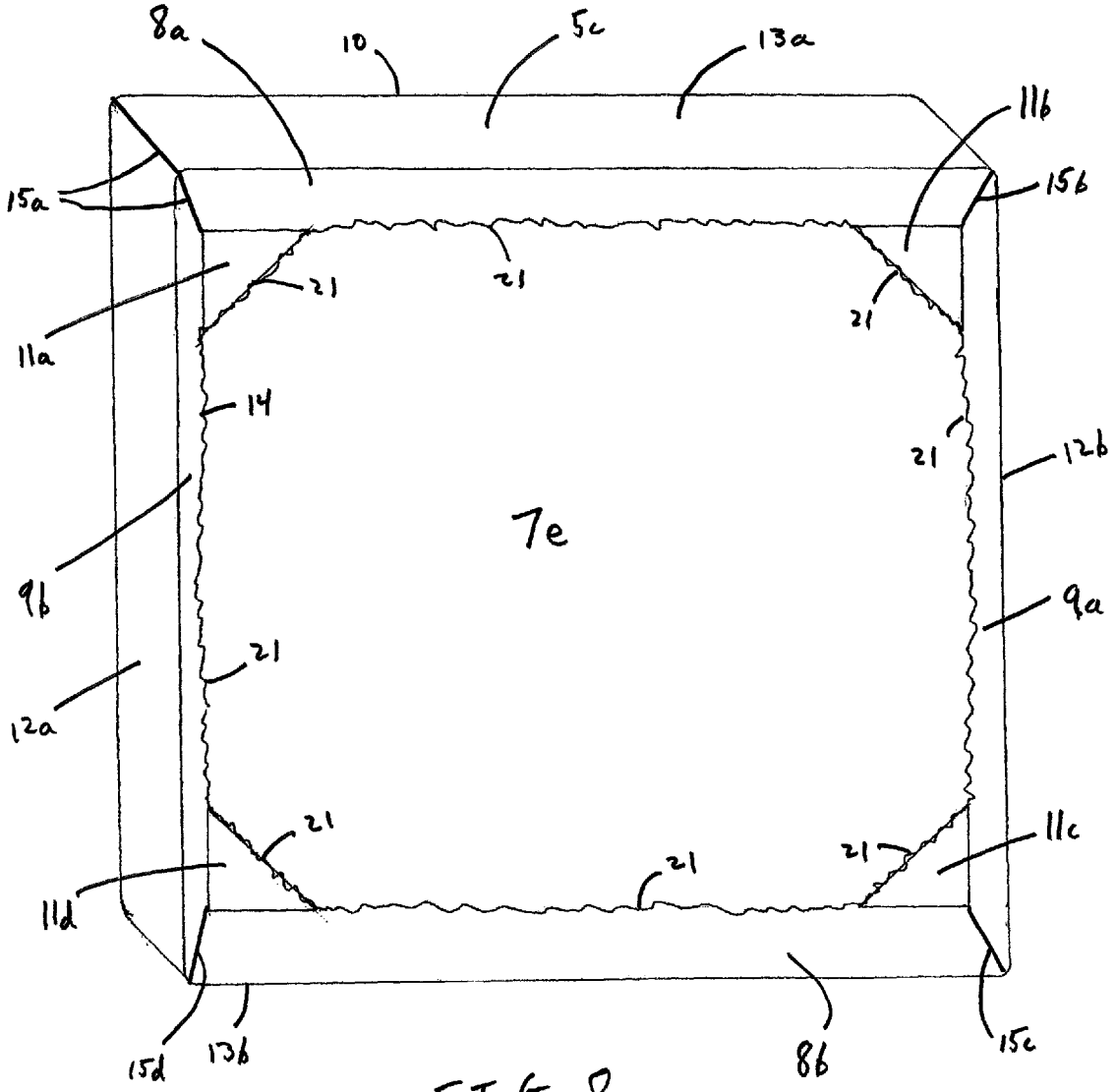
FIG. 8 illustrates an embodiment of the presently disclosed mattress cover installed on a king size mattress.
Figure 9:
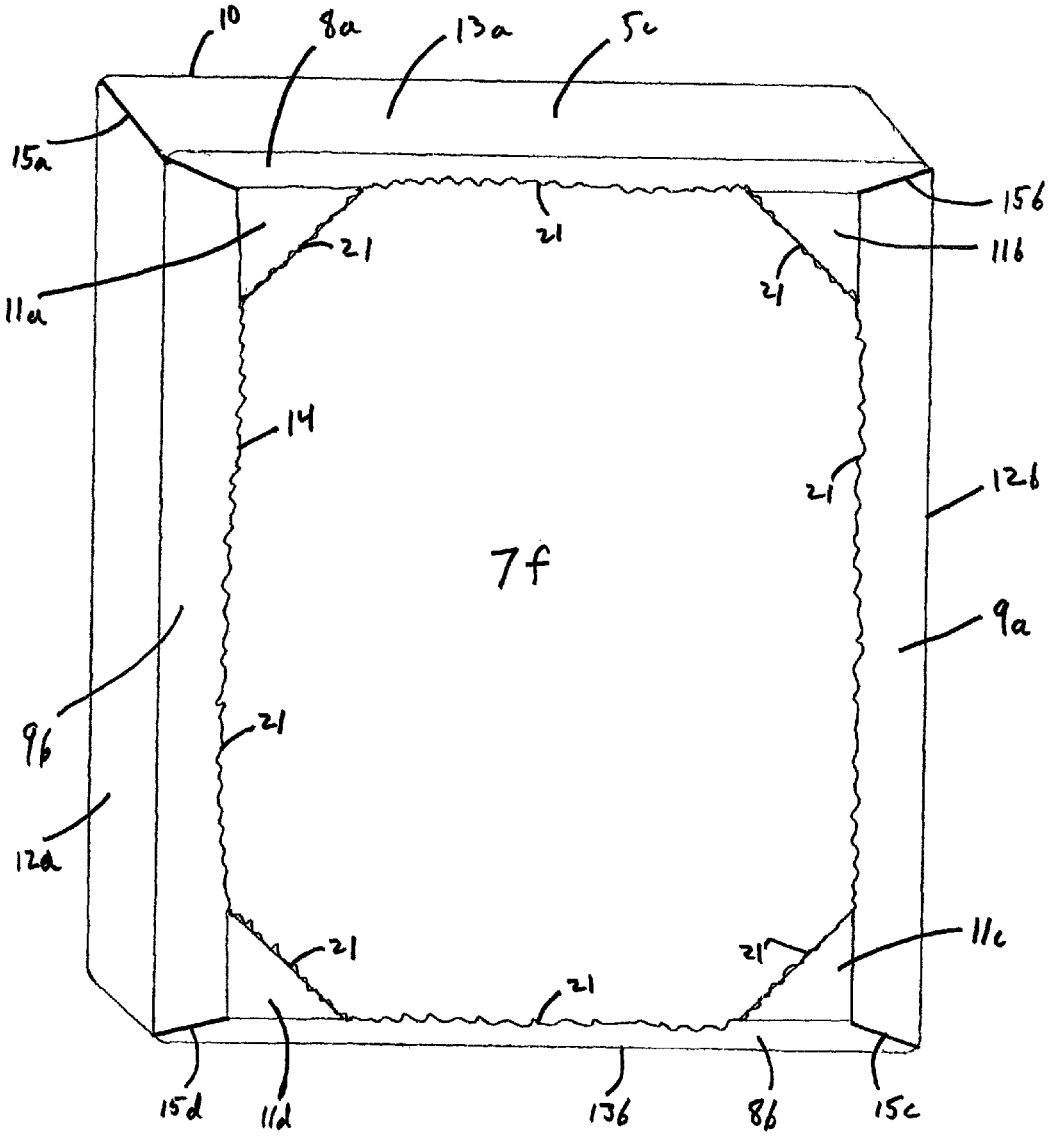
FIG. 9 illustrates an embodiment of the presently disclosed mattress cover installed on a California king sized mattress.

Similarly, referring now to FIG. 8 and FIG. 9, a mattress cover 5*c* is illustrated fitting both a king sized mattress 7*e* in FIG. 8 and a California king sized mattress 7*f* in FIG. 9. Once again, mattress cover 5*c* is configured to provide a substantially smooth covering and to be substantially free of undesirable bunched material, as well as staying substantially secured to the mattress when installed on either of the king sized mattress 7*e* or the California king sized mattress 7*f*. Mattress cover 5*c* can also accommodate king size mattress 7*e* and California king sized mattress 7*f* having various thicknesses, as discussed above, such as, for example, thicknesses varying from about six (6) inches to about 21 inches. Further still, mattress cover 5*c* may also accommodate king size mattress 7*e* and California king sized mattress 7*f* having varying widths, for example, widths ranging from about 76 inches to about 78 inches.

In addition to the exemplary embodiments discussed above, various other embodiments of the present invention are disclosed that may be used in relation to mattresses of other standard sizes, such as, for example, crib, toddler, queen, full, full extra-long, etc. Moreover, certain other embodiments may be used to accommodate mattresses manufactured according to foreign standards (e.g. UK standards such as small single (75 cm×190 cm), super king (180 cm×198 cm), etc.) and/or non-standard sizes that may fall substantially outside of the U.S. and/or foreign standard mattress sizes discussed herein. In each embodiment, the mattress cover may be configured to snugly fit a wide variety of mattress thicknesses and/or varying lengths and widths within each classification, and further be configured such that it is also easy to use, easy to care for, and economically feasible to manufacture.

Although cotton and cotton/polyester blends are typically used in most mattress covers, including certain embodiments of the mattress cover disclosed herein, many other fabric types may be used including, but not limited to, cotton, wool, silk, synthetics, nonwovens, quilted fabrics, felted fabrics, multi-layered fabric, waterproofed fabrics, and others.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments±100%, in some embodiments±50%, in some embodiments±20%, in some embodiments±10%, in some embodiments±5%, in some embodiments±1%, in some embodiments±0.5%, and in some embodiments±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

The foregoing detailed description of embodiments refers to the accompanying drawings, which illustrate specific embodiments of the invention. The term "the invention" or the like is used with reference to certain specific examples of the many alternative aspects or embodiments of the applicant's invention set forth in this specification, and neither its use nor its absence is intended to limit the scope of the applicant's invention or the scope of the claims. This specification is divided into sections for the convenience of the reader only. Headings should not be construed as limiting of the scope of the invention. The definitions are intended as a part of the description of the invention. It will be understood that various details of the present invention may be changed without departing from the scope of the present invention. Furthermore, the foregoing description is for the purpose of illustration only, and not for the purpose of limitation, as the present invention is defined by the claims as set forth hereinafter.

What is claimed is:

1. A mattress cover comprising:

a. a substantially rectangular piece of material comprising a top center portion for fitting upon a top surface of a mattress, and a peripheral skirt portion comprising two end panels extending from each end of the top center portion and two side panels extending from each side of the top center portion, wherein respective side edges of the end panels and side edges of the side panels are attached together at each corner to form fitted corners allowing for the peripheral skirt portion to fit over corresponding sides and ends of the mattress, wherein each fitted corner comprises a single upwardly extending seam;

b. corner panels manufactured from the same material as that of the top center portion and peripheral skirt portion, and attached directly to a bottom portion of each fitted corner formed from the respective attached end panels and side panels, wherein the corner panels are substantially parallel to the top center portion and include at least one interior edge, and wherein the corner panel, when attached to the bottom portion of each fitted corner, forms a corner pocket for receiving a corner of the mattress;

c. one or more elastic bands attached around a bottom periphery of an inside edge of the skirt portion and corner panels, wherein the one or more elastic bands attached at the inside edge of the corner panels is at about a 45° angle across each corner of a bottom surface of the mattress; and wherein, the substantially rectangular piece of material with the respective end panels and side panels attached together at each corner is configured for covering at least the top surface, sides, and ends of the mattress, and the corner panels attached to the bottom portion of each fitted corner formed from the respective attached end panels and side panels, and the one or more elastic bands attached around a bottom periphery of the inside edge of the skirt portion and corner panels are configured to fit substantially under the mattress and secure the mattress cover to the mattress.

2. The mattress cover of claim 1, wherein the mattress comprises at least one of a crib, toddler, twin, twin extra-long, full, full extra-long, queen, king, and California king size mattress.

3. The mattress cover of claim 1, wherein the mattress cover is configured to fit a mattress of thickness varying in the range of about 6 inches to about 21 inches.

4. The mattress cover of claim 1, wherein the mattress cover is configured to fit a mattress that varies in width in the range of about 37 inches to about 39 inches.

5. The mattress cover of claim 1, wherein the mattress cover is configured to fit a mattress that varies in width in the range of about 72 inches to about 78 inches.

6. The mattress cover of claim 1, wherein the corner panels are substantially triangular in shape.

7. The mattress cover of claim 6, wherein the corner panels comprise isosceles right triangles.

8. The mattress cover of claim 1, wherein the material comprises at least one of cotton, cotton/polyester blend, wool, silk, synthetic, nonwoven, quilted, felted, multi-layered fabric, and waterproofed material.

9. A method of making a mattress cover, the method comprising:

a. providing a first piece of material of sufficient size to cover a top area, sides, and ends of a mattress, wherein the first piece of material comprises two end and two side panel portions;

b. removing one of a substantially square or rectangular shaped portion from each corner of the first piece of material;

c. attaching edges of the end panel portions to respective edges of the side panel portions, thereby forming fitted corners each having a single upwardly extending seam at each corner of the first piece of material;

d. shaping the removed substantial square shaped portions to form corner panel portions manufactured from the same material as that of the top center portion and peripheral skirt portion and attaching the corner panel portions directly to a bottom portion of each fitted corner of the first piece of material, wherein the corner panel portions include at least one interior edge, and wherein the corner panel portions, when attached to the bottom portion of each fitted corner, forms a corner pocket for receiving a corner of the mattress; and e. attaching one or more elastic bands around substantially the entire periphery of an inner edge of a bottom portion of the mattress cover, wherein portions of the one or more elastic bands disposed at the corner panel portions are at about a 45° angle across each corner of a bottom surface of the mattress, and wherein the bottom portion of the mattress cover is formed by at least a portion of the two end and two side panel portions of the first piece of material and the corner panel portions.

10. The method of claim 9, wherein the mattress comprises at least one of a crib, toddler, twin, twin extra-long, full, full extra-long, queen, king, and California king size mattress.

11. The method of claim 9, wherein the edges of the end panel portions and the side panel portions are formed at the respective edges where the one of the substantially square or rectangular shaped portion was removed.

12. The method of claim 9, wherein the first piece of material comprises at least one of cotton, cotton/polyester blend, wool, silk, synthetic, nonwoven, quilted, felted, multi-layered fabric, and waterproofed material.

13. The method of claim 9, wherein the corner panel portions are substantially triangular.

14. The method of claim 9, wherein the corner panel portions comprise isosceles right triangles.

15. The method of claim 9, wherein the mattress cover is configured to fit a mattress of thickness varying in the range of about 6 inches to about 21 inches.

16. The method of claim 9, wherein the mattress cover is configured to fit a mattress that varies in width in the range of about 37 inches to about 39 inches.

17. The method of claim 9, wherein the mattress cover is configured to fit a mattress that varies in width in the range of about 72 inches to about 78 inches.

* * * * *